United States Patent [19]

Ikawa

[11] 4,288,722

[45] Sep. 8, 1981

[54] ELECTRONIC FLASH DEVICE

[75] Inventor: Kazuo Ikawa, Yokohama, Japan

[73] Assignee: Canon Kabushiki Kaisha, Tokyo, Japan

[21] Appl. No.: 70,422

[22] Filed: Aug. 28, 1979

[30] Foreign Application Priority Data

Sep. 7, 1978 [JP] Japan ..... 53-109975

[51] Int. Cl.[3] ..... H05B 41/32

[52] U.S. Cl. ..... 315/151; 315/241 P

[58] Field of Search ..... 315/151, 159, 241 P; 354/33, 145

[56] References Cited

U.S. PATENT DOCUMENTS

| | | | |
|---|---|---|---|
| 3,896,333 | 7/1975 | Nakamura | 315/151 |
| 3,998,534 | 12/1976 | Schulze et al. | 315/241 P X |
| 4,155,031 | 5/1979 | Kuraishi | 315/159 X |

*Primary Examiner*—Eugene R. La Roche

[57] ABSTRACT

A control circuit for an electronic flash device is disclosed. The control circuit is connected to a commutating capacitor and includes a coil connected in parallel to the capacitor and switching means connected in the discharge path of the commutating capacitor to discharge the charge stored on the commutating capacitor after a switching device for stopping flash emission has changed from the conducting state to the non-conducting state.

12 Claims, 1 Drawing Figure

ELECTRONIC FLASH DEVICE

BACKGROUND OF THE INVENTION

1. Field of the Invention

This invention relates to electronic flash devices and, more particularly, to a flash emission stopping circuit of an electronic flash device.

2. Description of the Prior Art

It is generally known to provide an automatic computer flash device of the series control type in which there is provided a switching element in series with the discharge tube in the discharge path of the main capacitor so that when the light measuring circuit produces a flash emission stopping signal, the charge stored on the commutating capacitor is discharged through the flash duration control switch. This applies a reverse bias to the switching element that is connected in series with the above-described discharge tube, thereby terminating the duration of the firing of the discharge tube.

In this conventional automatic computer flash device, the opening of the switching element is followed by charging of the commutating capacitor in the reverse direction through the discharge tube and, after the completion of that reversely-directed charging, the commutating capacitor is charged again in the direction reverse to that in which the first charging occurred to return to the initial state. This arrangement results in the disadvantage that this recovery time of the commutating capacitor, in returning to the initial state, amounts to as long as, for example, 0.2–0.3 (second). The reason for the large recovery time is because the capacitance of the commutating capacitor itself is large on account of its arrangement in the circuitry, and the resistor connected in the charge path of the commutating capacitor has also a very large resistance value.

SUMMARY OF THE INVENTION

An object of the present invention is to provide an electronic flash device which has a very short time interval between successive flash emissions.

For a better understanding of the present invention, reference is made to the following description and accompanying drawing, while the scope of the present invention will be pointed out in the appended claims.

DESCRIPTION OF THE PREFERRED EMBODIMENT

Figure 1:
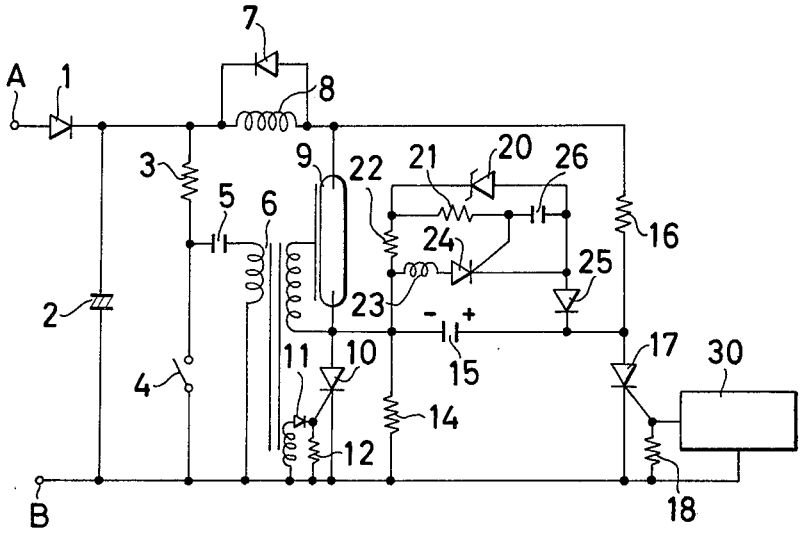
FIG. 1 is an electrical circuit diagram of an automatic computer flash device employing one form of the present invention.

With reference to the drawing, an automatic computer flash device of the present invention will be explained in detail below.

FIG. 1 shows one embodiment of the automatic computer flash device according to the present invention. Element 2 is a main capacitor for storing charge supplied through a rectifier diode 1 from an electrical power source terminal A. Connected in parallel with this main capacitor 2 is a series-connected circuit consisting of a coil 8 for moderating the discharge current characteristic of the main capacitor 2, a discharge tube 9 for flash emission, and a silicon controlled rectifier (hereinafter abbreviated as SCR) 10.

Element 7 is a diode for preventing the discharge current produced from the main capacitor 2 and connected in parallel to the coil 8; elements 3–6 are various elements constituting a trigger circuit for the discharge tube 9 with the element 5 being a trigger capacitor connected through a resistor 3 to the cathode of the diode 1, with the element 6 being a trigger transformer having a primary coil connected to the trigger capacitor 5, a secondary coil connected to the trigger electrode of the discharge tube 9, and a tertiary coil connected through a diode 11 to the gate of the SCR 10, and with the element 4 being a synchro-switch connected in parallel with the series-connected circuit which is composed of trigger capacitor 5 and the primary coil of the trigger transformer. Element 12 is a resistor connected to the gate of the SCR.

Elements 14–26 are various elements constituting a flash emission stopping circuit in which element 15 is a commutating capacitor connected in parallel to the main SCR 10 through a flash emission stopping SCR 17; element 14 is a resistor connected in parallel to the series-connected circuit composed of commutating capacitor 15 and flash emission stopping SCR 17; element 16 is a resistor connected between the coil 8 and the SCR 17 for charging the commutating capacitor 15 through the resistor 14; element 18 is a resistor connected to the gate of the SCR 17; element 20 is a Zener diode with its cathode connected to the cathode of the discharge tube 9 through a resistor 22; element 21 is a resistor which, together with a capacitor connected in series to it, form a timing circuit; element 23 is a coil forming a ringing circuit with the commutating capacitor 15; element 24 is an SCR connected in series with the coil 23 to control the initiation of the ringing of the ringing circuit, with its gate connected to the timing capacitor 26, that is, the output of the timing circuit, and with its cathode connected to the anode of a diode 25 for stopping the current due to the ringing in a half cycle. Element 30 is a light measuring circuit known from, for example, Japanese Laid-Open Pat. Sho No. 44-30905, with its output terminal connected to the gate of the SCR 17.

The operation of the device of such construction will next be described. While the main capacitor 2 is first charged through the diode 1, the commutating capacitor 15 also is charged through the coil 8 and resistors 16 and 14 to the polarity shown in the FIGURE. Then, when the synchro-switch 4 is closed, the charge stored on the trigger capacitor 5 is discharged through the synchro-switch 4 and the primary of the trigger transformer 6 to produce a trigger pulse in the secondary and tertiary coils of the transformer. In this manner, the discharge tube 9 and SCR 10 are triggered to permit the charge on the main capacitor 2 to be discharged through the discharge tube 9 and SCR 10. Thus, the discharge tube 9 emits an intense flash of light with which an object being photographed is illuminated.

When the light reflected from the object has reached a predetermined critical level, the light measuring circuit 30 produces a flash emission stopping signal in a manner known in the art. This signal is applied to the gate of the emission stopping SCR 17, by which the SCR 17 is rendered conducting. The charge on the commutating capacitor 15 is discharged through the SCR 17 and the resistor 14 to apply a reverse bias to the main SCR 10, by which the main SCR 10 is gated off. When the main SCR 10 is rendered non-conducting, the charge on the main capacitor 2 changes its discharge path from the main SCR 10 to a first closed circuit which can be traced from the positive pole of the main capacitor 2 through the coil 8, discharge tube 9, commutating capacitor 15 and SCR 17 to the negative pole of the main capacitor 2, and a second closed circuit which can be traced through the discharge tube 9, resistors 21 and 22, timing capacitor 26, diode 25 and SCR 17. For this reason, the commutating capacitor 15 starts to be charged in the reverse direction to that in which it was charged at the initial stage of flash emission (hereinafter referred to as reverse charge). The timing capacitor 26 also starts to be charged.

When this reversed charge of the commutating capacitor 15 has been completed, the SCR 17 is biased in the reverse direction by the voltage of the charged commutating capacitor 15 so that the SCR is again gated off. When the SCR 17 is rendered non-conducting, the above-described first and second closed circuits are cut off to permit the charge which has been stored on the commutating capacitor 15 during the reverse charging operation to be discharged through the resistor 22, timing circuit 21, 26 and diode 25. This causes a further increase in the output voltage of the timing circuit. When this output voltage exceeds the trigger level for the SCR 24, the SCR 24 is gated on to establish the ringing circuit with instantaneous production of the ringing phenomenon which results in the flow of a current from the commutating capacitor 15 through the coil 23, SCR 24 and diode 25.

By this discharge current, the polarity of voltage of the commutating capacitor 15 is inverted. When the voltage of the inverted sign across the terminals has reached a level almost equal to the peak value, that is, the voltage level at the initial stage of the ringing phenomenon, the discharge current in the ringing circuit tends to change its direction. The diode 25, however, functions to inhibit the occurrence of this reverse-directed discharge current, so that the ringing phenomenon disappears in a half cycle and, therefore, the polarity of the commutating capacitor 15 is retained in the initial state as shown in the FIGURE.

After that, an additional charge is made on the commutating capacitor 15 through the resistor 16. Since a considerable charge had been stored on the commutating capacitor 15 by the above-described ringing operation, the recharging operation of the commutating capacitor 15 terminates in a short time. Thus, all the portions of the circuit recover the initial state. For the next firing, the synchro-switch 4 needs to be closed again.

It will be appreciated from the foregoing that the present invention is intended to very substantially shorten the time necessary for the commutating capacitor to recover the initial state after the firing is stopped by providing a circuit for instantaneously inverting the polarity of voltage on the commutating capacitor after the light emission stopping SCR changes from the conducting to the non-conducting state. According to the present invention, therefore, the time interval between successive firings is made shorter than in the conventional electronic flash device, thereby providing the advantage that it is possible to perform a succession of firings at a higher frequency.

While the foregoing description and drawings represent the preferred embodiments of the present invention, it will be obvious to those skilled in the art that various changes and modifications may be made therein without departing from the true spirit and scope of the present invention.

What is claimed is:

1. An electronic flash device comprising:

(a) flash tube means responsive to a discharge current for illuminating an object to be photographed to obtain a desired exposure level;

(b) main switching means connected in series with said flash tube means to form a discharge path for the discharge current when said main switching means is in a conductive state;

(c) subsidiary switching means coupled to said main switching means for rendering said main switching means non-conductive when the desired exposure level is obtained;

(d) a commutating capacitor connected between said flash tube means and said subsidiary switching means so that said commutating capacitor is charged in a forward direction through said main switching means when said subsidiary switching means is in a non-conductive state and said commutating capacitor is charged in the reverse direction through said subsidiary switching means when said subsidiary switching means is in a conductive state;

(e) a series circuit coupled across said commutating capacitor and including coil means and third switching means; and (f) trigger means connected to said third switching means for applying a closing signal to close said third switching means to form a ringing circuit of said commutating capacitor and said series circuit after said subsidiary switching means is in the non-conductive state and said commutating capacitor has been charged in the reverse direction so that said commutating capacitor then discharges through said series circuit.

2. An electronic flash device according to claim 1, wherein said third switching means includes a one-way conductive element having a control electrode connected to said trigger means to allow said commutating capacitor to discharge electric charge supplied to said commutating capacitor in the reverse direction.

3. An electronic flash device according to claim 2, wherein said one-way conductive element comprises a SCR.

4. An electronic flash device according to claim 1, wherein said series circuit includes a one-way conductive element connected to said commutating capacitor to allow said commutating capacitor to discharge electric charge supplied to said commutating capacitor in the reverse direction.

5. An electronic flash device according to claim 4, wherein said one-way conductive element comprises a diode.

6. An electronic flash device according to claim 5, wherein said diode is connected between said third switching means and said comutating capacitor.

7. An electronic flash device according to claim 1, wherein said trigger means includes a delay circuit which starts a delay operation simultaneously with the start of charging of said commutating capacitor in the reverse direction.

8. An electronic flash device according to claim 7, wherein said delay circuit comprises a resistor and a timing capacitor arranged so that said timing capacitor is charged through said flash tube means to provide said closing signal.

9. An electronic flash device according to claim 8, further comprising a constant voltage device connected in parallel to said delay circuit.

10. An electronic flash device according to claim 9, wherein said constant voltage device includes a Zener diode.

11. An electronic flash device comprising:

(a) flash tube means responsive to a discharge current for illuminating an object to be photographed to a desired exposure level;

(b) main switching means connected in series with said flash tube means to form a discharge path for the discharge current when said main switching means is in a conductive state;

(c) subsidiary switching means coupled to said main switching means for rendering said main switching means non-conductive when the desired exposure level is obtained;

(d) a commutating capacitor coupled between said flash tube means and said subsidiary switching means so that said commutating capacitor is charged in a forward direction through said main switching means when said subsidiary switching means is in a non-conductive state and said commutating capacitor is charged in the reverse direction through said subsidiary switching means when said subsidiary switch means is in a conductive state; and (e) ringing means connected in parallel to said commutating capacitor for forming a ringing circuit after said subsidiary switching means is in the non-conductive state and said commutating capacitor has been charged in the reverse direction, said ringing means including a one-way conductive element for discharging said commutating capacitor.

12. An electronic flash device according to claim 11, wherein said one-way conductive element comprises a thyristor.

* * * * *